US010413022B2

(12) United States Patent
Porto et al.

(10) Patent No.: US 10,413,022 B2
(45) Date of Patent: Sep. 17, 2019

(54) BUCKLE COMPRISING PAWLS BIASED BY MAGNETIC REPELLING FORCE

(71) Applicant: 3M INNOVATIVE PROPERTIES COMPANY, St. Paul, MN (US)

(72) Inventors: Ariane Sarzi Porto, São Paulo (BR); Nelson Pudles, Curitiba (BR); Nathan W. Safe, Red Wing, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/118,069

(22) Filed: Aug. 30, 2018

(65) Prior Publication Data

US 2019/0116939 A1 Apr. 25, 2019

Related U.S. Application Data

(60) Provisional application No. 62/576,932, filed on Oct. 25, 2017.

(51) Int. Cl.
*A44B 11/26* (2006.01)
*A44B 11/25* (2006.01)

(52) U.S. Cl.
CPC ..... *A44B 11/266* (2013.01); *A44B 11/2507* (2013.01); *A44B 11/2519* (2013.01); *A44D 2203/00* (2013.01)

(58) Field of Classification Search
CPC ..... A44B 11/2507; A44B 11/266; A44D 2203/00
See application file for complete search history.

(56) References Cited

U.S. PATENT DOCUMENTS

| | | | | |
|---|---|---|---|---|
| 5,323,516 | A | 6/1994 | Hartmann | |
| 6,668,434 | B2 | 12/2003 | Casebolt | |
| 6,698,070 | B2 | 3/2004 | Chen | |
| 6,965,231 | B1 * | 11/2005 | Cinoglu | A61B 5/0555 324/300 |
| 7,373,701 | B2 | 5/2008 | Coulombe | |
| 8,181,319 | B2 | 5/2012 | Johnson | |
| 8,555,470 | B2 | 10/2013 | Spataro | |
| 8,978,213 | B2 | 3/2015 | Hayton | |
| 9,521,882 | B2 * | 12/2016 | Hung | A44B 11/2511 |
| 9,578,929 | B2 | 2/2017 | Hung | |
| 9,585,445 | B2 | 3/2017 | Qian | |
| 2011/0239413 | A1 | 10/2011 | Milbright | |
| 2014/0082894 | A1 | 3/2014 | Walker | |

FOREIGN PATENT DOCUMENTS

| | | |
|---|---|---|
| FR | 2374051 | 7/1978 |
| FR | 2612378 | 9/1988 |
| GB | 1262537 | 2/1972 |
| WO | WO 2012-135891 | 10/2012 |

OTHER PUBLICATIONS

Exofit, "Full Body Harnesses", Exofit Catalog, 2011, 4 pages.

* cited by examiner

*Primary Examiner* — Robert Sandy
*Assistant Examiner* — David M Upchurch
(74) *Attorney, Agent, or Firm* — Kenneth B. Wood

(57) ABSTRACT

A buckle with a first pawl that is biased by a pair of magnets that are oriented in opposition to each other to provide a repelling force, and with a second pawl that is biased by another pair of magnets that are oriented in opposition to each other to provide a repelling force.

19 Claims, 5 Drawing Sheets

BUCKLE COMPRISING PAWLS BIASED BY MAGNETIC REPELLING FORCE

BACKGROUND

Buckles are widely used in the art for coupling two straps or webbings together, e.g. for use in safety harnesses and the like.

SUMMARY

In broad summary, herein is disclosed a buckle with a first pawl that is biased by a pair of magnets that are oriented in opposition to each other to provide a repelling force, and with a second pawl that is biased by another pair of magnets that are oriented in opposition to each other to provide a repelling force. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Figure 1:
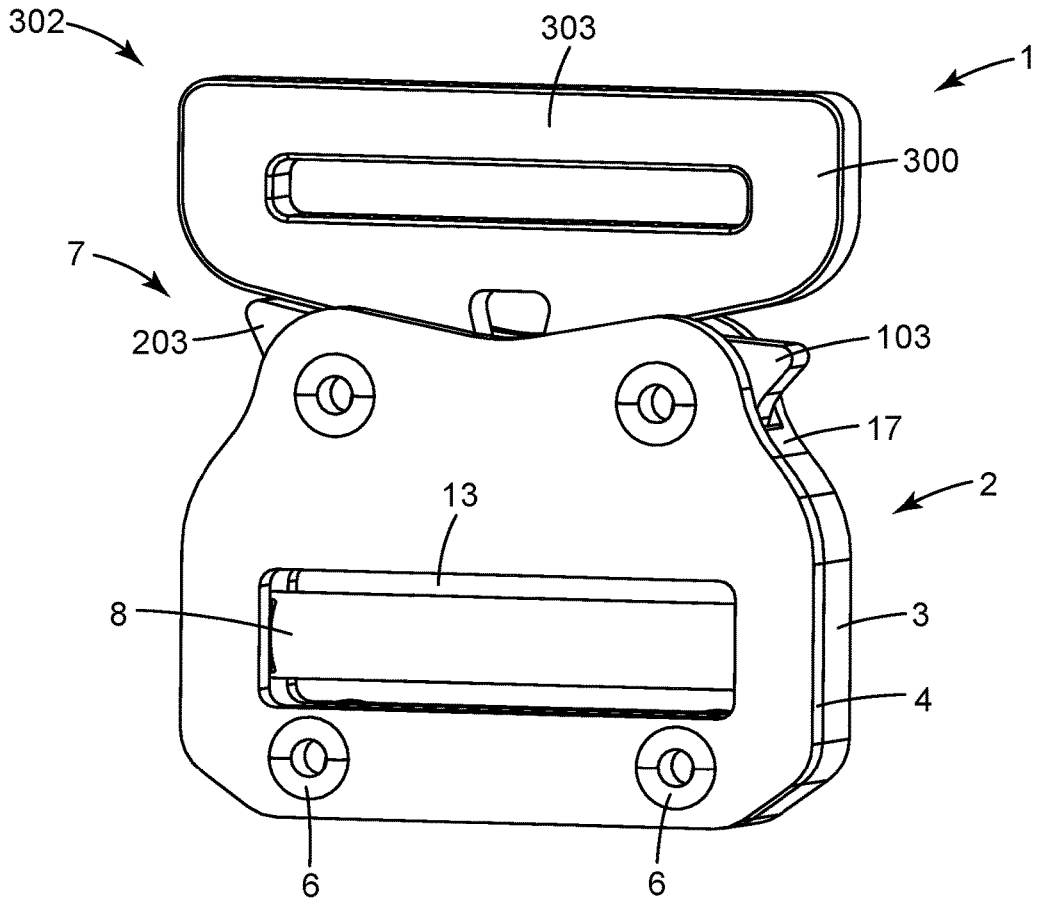
FIG. 1 is a perspective view of an exemplary buckle with a catch engaged therewith.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted. In particular, certain components may be present in interchangeable and/or identical multiples (e.g., pairs) and may be designed as first and second purely for convenience.

As used herein, the term forward and like terms refers to a direction generally along a direction of insertion of a catch into a buckle; the term rearward refers to a direction generally opposite such a catch-insertion direction. (For example, forward and rearward directions are respectively downward and upward in the view of FIG. 1.) The term lateral refers to a direction that is generally inward/outward relative to a forward-rearward centerline of the buckle (an exemplary centerline $L_c$ is depicted in FIG. 2; lateral directions will be side-to-side in the view of FIG. 2).

As used herein as a modifier to a property or attribute, the term "generally", unless otherwise specifically defined, means that the property or attribute would be readily recognizable by a person of ordinary skill but without requiring a high degree of approximation (e.g., within +/−20% for quantifiable properties). The term "substantially", unless otherwise specifically defined, means to a high degree of approximation (e.g., within +/−10% for quantifiable properties). The term "essentially" means to a very high degree of approximation (e.g., within plus or minus 2% for quantifiable properties); it will be understood that the phrase "at least essentially" subsumes the specific case of an "exact" match. However, even an "exact" match, or any other characterization using terms such as e.g. same, equal, identical, uniform, constant, and the like, will be understood to be within the usual tolerances or measuring error applicable to the particular circumstance rather than requiring absolute precision or a perfect match. The term "configured to" and like terms is at least as restrictive as the term "adapted to", and requires actual design intention to perform the specified function rather than mere physical capability of performing such a function. All references herein to numerical parameters (dimensions, ratios, and so on) are understood to be calculable (unless otherwise noted) by the use of average values derived from a number of measurements of the parameter, particularly for the case of a parameter that is variable.

DETAILED DESCRIPTION

Figure 2:
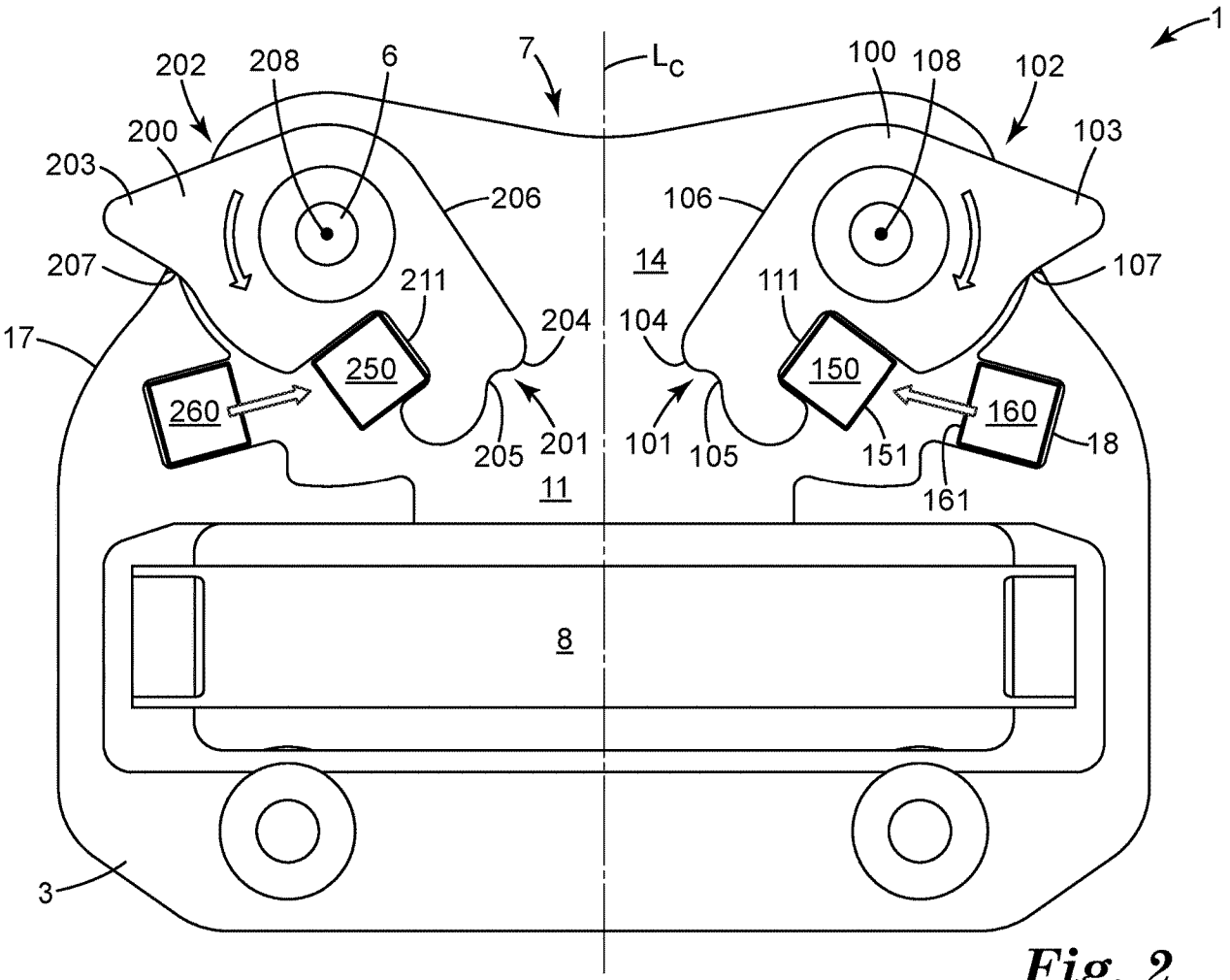
FIG. 2 is a plan view of an exemplary buckle, with a plate omitted so as to depict pawls in a first, ready configuration.

Shown in FIG. 1 is a perspective view of an exemplary buckle 1. As illustrated, buckle 1 includes a main body 2 (chassis) comprising a first plate 3 and a second plate 4, which are non-removably attached to each other e.g. by a suitable number of mechanical fasteners 6, e.g. rivets, screws, bolts and so on. A slide 8 is coupled between first and second plates 3 and 4 and is retained within a space 13 provided by aligned openings in the first and second plates. Slide 8 is thus configured so that a strap or webbing (e.g. of a harness) can be non-removably secured to slide 8 in a manner well understood in the art. This may be done e.g. by passing a terminal end of the webbing through space 13 and around slide 8 and fastening (e.g. sewing) the terminal end of the webbing to a penultimate section of the webbing. Another strap or webbing may be likewise secured to a rear bar 303 of rearward end 302 of catch 300, again as will be well understood. Buckle 1 and catch 300 can thus provide that the two webbings can be connected to each other and disconnected from each other as desired.

In FIG. 2, a plan view of buckle 1 is presented with catch 300 omitted and with second plate 4 omitted (as it is in FIGS. 3-5) for ease of presentation of various components of the buckle. As evident in FIG. 2, sandwiched between first plate 3 and second plate 4 are first and second pawls 100 and 200 (which may or may not be identical, but are given separate numbers for convenience of description) that engage with a forward, engaging end 301 of catch 300 to secure catch 300 to buckle 1 as described below. Pawls 100 and 200 are positioned within a space 11 between first and second plates 3 and 4. In many embodiments, most of the volume of each pawl may remain within this space regardless of the rotational position of the pawls. However, first and second pawls 100 and 200 each respectively comprise an actuating portion 103 and 203 (e.g., a tab or wing) that protrudes outward (e.g. generally laterally and/or rearwardly) beyond a perimeter 17 of main body 2 of buckle, for purposes described later herein. Pawl 100 comprises at least one engaging portion that provides an engaging end 101 of pawl 100. The engaging portion of pawl 100 comprises at least one tooth 104, which may be located e.g. at least generally proximate engaging end 101 of pawl. Pawl 200 likewise comprises an engaging portion comprising at least one tooth 204 that may be located e.g. proximate an engaging end 201 of pawl 200.

Pawls 100 and 200 are non-overlapping with each other (as is readily apparent from FIG. 2) regardless of the rotational position of each pawl. Pawls 100 and 200 are pivotally mounted on chassis 2. In a convenient embodiment, such pawls may each be pivotally attached to chassis 2 by way of a mechanical fastener (e.g. a rivet 6 that is used to fasten the first and second plates together to form the chassis) that passes through a bore in the pawl and that thus coincides with the axis of rotation 108 and 208 of the pawls, as evident e.g. in FIG. 2. Pawls 100 and 200 are counter-rotating pawls, meaning that in ordinary use of buckle 1 such as in the acts of inserting catch 300 into buckle 1 and removing catch 300 from buckle 1, the pawls are consistently urged into rotationally-opposite motion. That is, when one of the pawls is urged to rotate in one direction the other pawl will be urged to rotate in a an opposite direction (for example, if one pawl is urged to rotate clockwise, the other pawl will be urged to rotate counter-clockwise).

Pawls 100 and 200 are biased (by a biasing system as described later herein) to counter-rotate so that their respective engaging ends 101 and 201 are urged generally laterally inward (as signified by the curved block arrows in FIG. 2) toward a lateral centerline $L_c$ of buckle 1. In the absence of any external urging force, the biasing system will cause pawls 100 and 200 to exhibit an orientation of the general type shown in FIG. 2, which is a first, "ready" configuration in which buckle 1 is ready to receive catch 300. The extent to which pawl 100 can rotate to move engaging end 101 toward a lateral centerline of buckle 1 is limited by a mechanical stop 107 which is provided by an interaction of a portion of the chassis of the buckle, with a portion of pawl 100, as evident in FIG. 2. Pawl 200 comprises a similar mechanical stop 207. Thus, when in their first, "ready" configuration, engaging end 101 of pawl 100 and engaging end 201 of pawl 200 will be at a distance of closest approach to each other (and to the lateral centerline of the buckle). In other words, any movement of the pawls away from this first configuration will move the engaging ends of the pawls away from each other.

Figure 4:
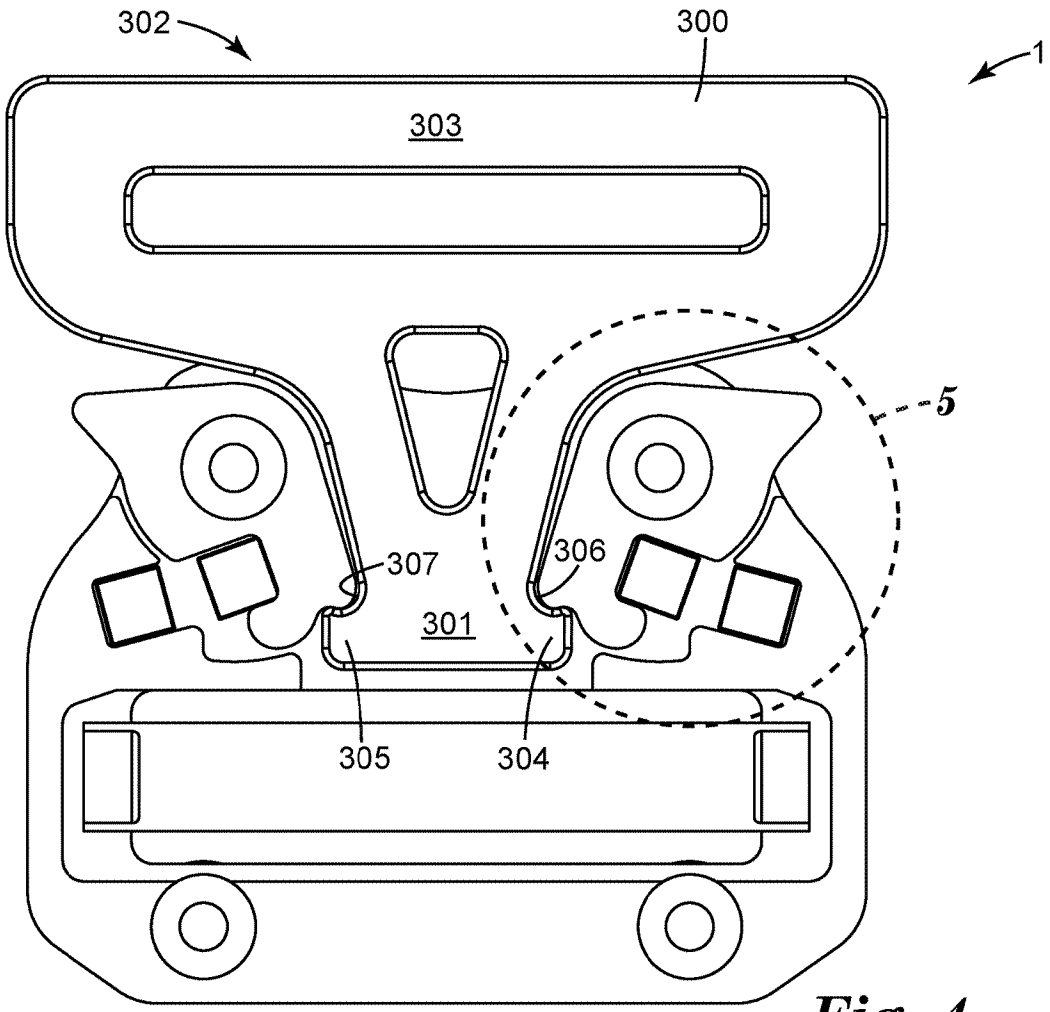
FIG. 4 is a plan view of the exemplary buckle of FIG. 2, with the pawls rotatably moved into a third, latched configuration.

Main body 2 of buckle 1 has a receiving end 7 that is sized and configured to receive catch 300. An exemplary catch 300 that can be used with buckle 1 is shown in FIGS. 1 and 4. In many convenient embodiments, a catch 300 may be generally "T"-shaped, with a relatively laterally wide rearward bar 303 that is configured to have a strap or webbing attached thereto, and with the forward end of the shaft of the "T" (i.e., engaging end 301) comprising shoulders 304 and 305. Shoulders 304 and 305 respectively define lateral notches 306 and 307 that are located e.g. immediately rearwardly of shoulders 304 and 305 as visible in the exemplary embodiment of FIG. 4. Catch 300 thus comprises a forward portion that is configured to be slidably inserted into space 11 between plates 3 and 4 so that an engaging end 301 of the forward portion of catch 300 penetrates into space 14 between pawls 100 and 200.

Figure 3:
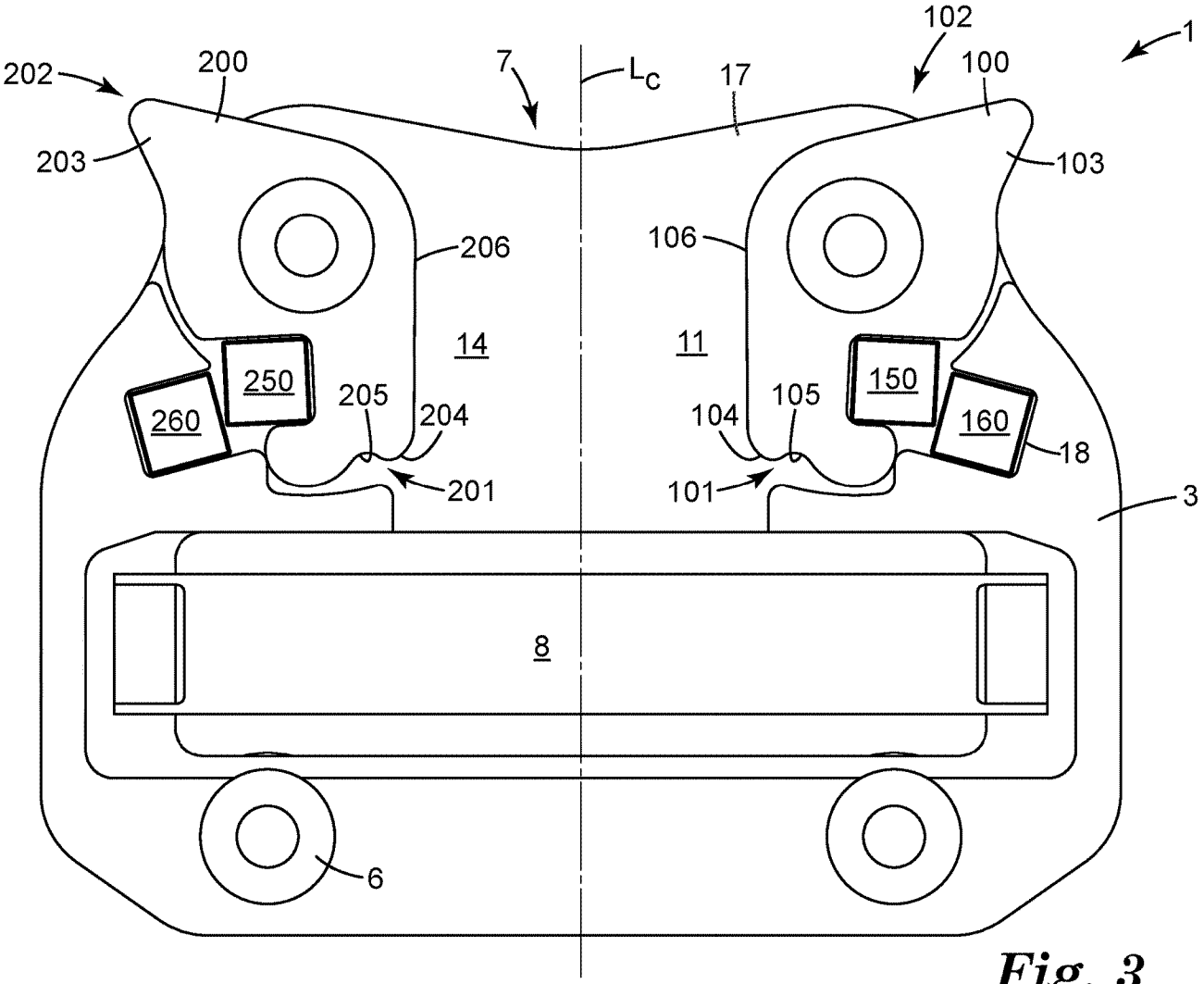
FIG. 3 is a plan view of the exemplary buckle of FIG. 2, with the pawls rotatably moved into a second, insertion/removal configuration.

In use of buckle 1 to secure a catch 300 to buckle 1, a forward portion of catch 300 is forwardly slidably inserted into receiving end 7 of buckle 1 so that engaging end 301 of catch 300 travels into interior space 11 of chassis 2 and into space 14 between pawls 100 and 200. Forward movement of catch 300 causes lateral edges of engaging end 301 of catch 300 to impinge on major contact surfaces 106 and 206 of pawls 100 and 200 thus overcoming the above-mentioned biasing force and urging the engaging ends 101 and 201 of pawls 100 and 200 laterally outward, away from the lateral centerline of the buckle and away from one another. Continued forward movement of catch 300 into buckle 1 causes the pawls to counter-rotate into an "insertion/removal" configuration in which the pawls do not interfere with slidable movement of catch 300 in either a forward or rearward direction, within the space 14 between the pawls. An exemplary insertion/removal configuration is shown in FIG. 3. In such a configuration, engaging ends 101 and 201 of pawls 100 and 200 will be relatively widely separated from each other and major contact surfaces 106 and 206 of pawls 100 and 200 may be at least generally parallel to each other, as in FIG. 3.

Upon still further insertion of catch 300 forwardly into interior space 11 of buckle 1, shoulders 304 and 305 of catch 300 will penetrate sufficiently forward past teeth 104 and 204 of pawls 100 and 200, that, under the urging of the biasing system, the pawls will counter-rotate so that the engaging ends 101 and 201 of pawls 100 and 200 snap back toward the lateral centerline of the buckle (and toward one another). This causes teeth 104 and 204 of pawls 100 and 200 to engage with shoulders 304 and 305 of catch 300. By this is meant that teeth 104 and 204 reside rearwardly behind shoulders 304 and 305, e.g. in notches 306 and 307 of catch 300, as shown in FIG. 4. (Likewise, shoulders 304 and 305 respectively reside in notches 105 and 205 of pawls 100 and 200.)

In this configuration, the interference of the teeth of the pawls with the shoulders of the catch physically prevents the catch from being moved slidably rearwardly to remove it from the buckle; in other words, the buckle and catch are now in a third, latched (secured) configuration as shown in exemplary embodiment in FIG. 4. It will be appreciated that no ancillary manipulation of any components of buckle 1 or catch 300 (e.g. pressing of buttons, turning of handles, etc.) is required to achieve such latching; all that is required is to insert catch 300 forwardly into the interior of buckle 1 until the pawls snap into place.

Catch 300 cannot be removed from buckle 1 until pawls 100 and 200 are counter-rotated to an "insertion/releasing" orientation. In order to do this, a user can (e.g. with thumb and forefinger) manually apply force to actuating portions 103 and 203 that protrude from rearward portions 102 and 202 of pawls 100 and 200. The force is applied so as to urge the actuating portions generally rearward and laterally inward toward each other, thus overcoming the biasing force of the biasing system and urging the engaging ends of the pawls pawl laterally outward and away from each other. Upon the pawls reaching an "inserting/releasing" configuration e.g. as shown in the exemplary illustration of FIG. 3, catch 300 can be slidably moved rearwardly to disengage catch 300 from buckle 1. (Once shoulders 304 and 305 of catch 300 have moved sufficiently rearward to be clear of teeth 104 and 204 of pawls 100 and 200, it may no longer be necessary to manually apply force to the actuating portions of the pawls during the remainder of the process of slidably removing catch 300 from buckle 1).

The above arrangements provide that buckle 1 and catch 300 can thus be securely latched together, unlatched, latched again, and unlatched again, as desired.

As noted above, buckle 1 comprises a biasing system that urges pawls 100 and 200 to counter-rotate so that the engaging ends 101 and 201 of the pawls are urged generally laterally inward toward each other (along respective arcuate paths). Using pawl 100 as an example (and with reference to FIG. 5, which is a magnified isolated view of pawl 100 as shown in FIG. 4), the biasing system relies on a first magnet 150 that is mounted on pawl 100, working in combination with a second magnet 160 that is mounted on chassis 2 of buckle 1. The magnets are oriented in a configuration in which they repel each other; i.e., they are in opposition to each other. By this is meant that the magnets are configured so that one pole 151 (e.g. a "north" pole) of the pawl-mounted magnet 150 is oriented at least generally toward a like pole 161 (a "north" pole, in this example) of the chassis-mounted magnet 160. Pawl-mounted magnet 150 is positioned forward of the axis of rotation 108 of pawl 100 (e.g., it may be positioned at least generally proximate engaging end 101 of pawl 100) so that the repelling force between magnets 150 and 160 causes engaging end 101 of pawl 100 to be urged laterally inwardly, e.g. in the general direction indicated by the block arrow in FIG. 5 (and by the straight block arrows in FIG. 2). Similar arrangements may be made for second pawl 200. That is, a third magnet 250 may be mounted on pawl 200, and a fourth magnet 260 may be mounted on chassis 2 of buckle 1, oriented so that the third and fourth magnets are at least generally in opposition to each other so that they repel each other, and arranged so that the repelling force causes engaging end 201 of pawl 200 to be urged laterally inwardly, as shown in FIG. 2.

The arrangements disclosed herein thus rely on two pairs of magnets, each pair serving to bias one pawl and each pair including a magnet mounted on the pawl and a magnet mounted on the chassis (main body) of the buckle with the magnet pair being oriented so that the magnets of the pair repel each other over the entire permitted range of rotational motion of the pawl relative to the chassis. It will be appreciated that the arrangements herein rely on magnet pairs that are configured in repelling mode rather than in attracting mode. In fact, in the present arrangement, even magnets that are not configured to repel each other (e.g., the first and third, pawl-mounted magnets 150 and 250 as shown in FIG. 4) do not exert any attractive force on each other that is of any consequence to the functioning of the buckle. By way of a numerical example, in various embodiments the first magnet and the third magnet will not exhibit an attractive force between each other that is greater than 10, 5, 2, or 1% of the repelling force between the first magnet and the second magnet, over an entirety of a range of counter-rotatable motion of the first and second pawls. In other words, any attractive force between the first and third magnets will remain below such a limit, regardless of the positions of the first and second pawls. It will thus be appreciated that the arrangements disclosed herein do not rely on magnets arranged in a repelling configuration that is used in combination with, or as an adjunct to, magnets that are arranged in an attractive configuration. Such arrangements may be contrasted to e.g. the arrangements presented in U.S. Pat. No. 8,555,470.

It will be appreciated that a magnetic-repulsion biasing system as disclosed herein may exhibit any number of enhancements over a biasing system that relies on e.g. compression springs. For example, the magnets are not deformed to any extent during use of the buckle and thus they are not subject to repeated compression/expansion cycles that may serve to change the behavior (e.g. the spring constant) of a conventional spring. Furthermore, magnetic repulsion generally follows an inverse square law, in contrast to e.g. springs that exhibit generally linear force-displacement curves. A magnetic-repulsion biasing system thus may exhibit biasing force that is more sensitive to displacement (that is, that increases more steeply as the magnets are brought closer to each other) and thus offers enhanced sensory feedback to a user of the buckle.

Again using first and second magnets 150 and 160 as an example, these magnets can be made of any suitable material, and can be configured in any suitable size, shape and orientation, to provide the desired biasing force over the working distances (e.g., a few millimeters) that will often be present in a buckle e.g. of a harness. As previously noted, the magnet pair 150 and 160 will be positioned so that like poles of each magnet (e.g. poles 151 and 161 as pointed out in FIG. 4) will at least generally face each other, so that a repelling force between the magnets is achieved. Within these general constraints, the specific orientation of the magnets can be chosen to advantage.

Figure 5:
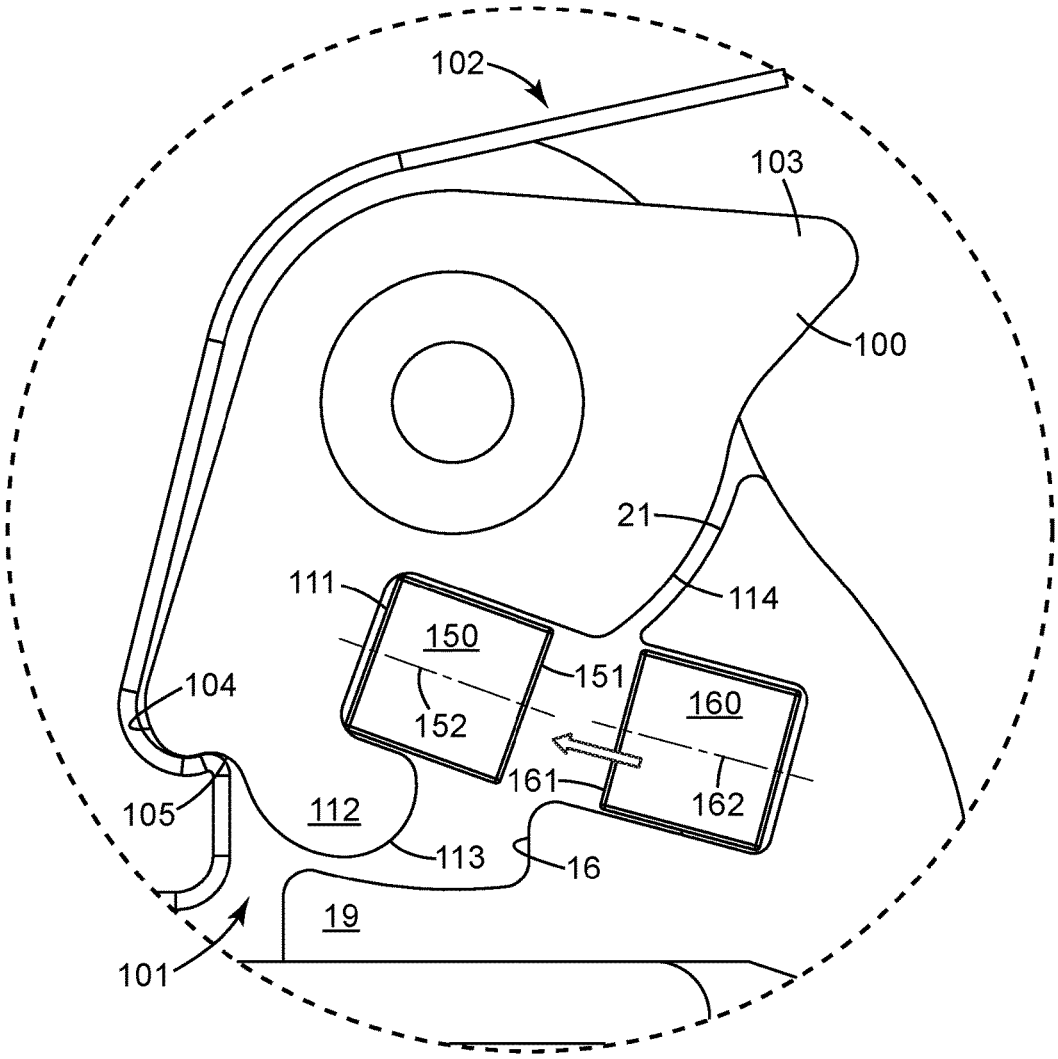
FIG. 5 is an isolated magnified view of a portion of the exemplary buckle of FIG. 4.

In further detail, magnet 150 will exhibit a "north-south" axis 152, and magnet 160 will exhibit a similar axis 162, as indicated in FIG. 5. In embodiments in which pawl 100 is pivotally mounted to chassis 2, pawl 100 and magnet 150 mounted thereon will follow an arcuate path during the manipulations described herein. This means that as pawl 100 is moved relative to chassis 2, the north-south axis 152 of magnet 150 will not remain in a constant orientation in relation to the north-south axis 162 of magnet 150. (This is readily evident from comparison of the orientation of these magnets in FIGS. 2, 3 and 4.) The maximum magnetic repulsion may be expected when these axes are nearly exactly aligned with each other (both in terms of angular orientation and rectilinear displacement or offset). The magnets may be arranged so that this condition of maximum repelling occurs at or along a desired location within the overall range of rotational movement of the pawl. In some embodiments, the pawl-mounted magnet 150 and the chassis-mounted magnet 160 can be configured so that these axes are somewhat misaligned when the pawl is in the "ready" configuration (as in FIG. 2) and become more aligned with each other as the pawl is rotated (against the biasing force) away from this configuration (e.g. toward the position of FIG. 3 or 4). This may further enhance the steepness of the magnetic force versus displacement curve and provide further enhanced sensory feedback when a user is manipulating the actuation portions of the pawls to urge the pawls into an insertion/removal configuration.

In addition, configuring the magnets so that a peak repelling force occurs when the engaging ends of the pawls are near their maximally spread configuration (e.g., when the pawls are in the insertion/removal configuration of FIG. 3) can ensure that when the shoulders of the catch penetrate past the teeth of the pawls, the engaging ends of the pawls will be forced back toward each other (and into engagement with the catch) forcefully. This may enhance the auto-engaging characteristics of the pawls (e.g. relative to a spring that exhibits a substantially linear spring constant) and/or may allow the pawls to engage the catch e.g. with a noticeably audible click. Such arrangements can enhance the ability to determine that the catch has been successfully engaged with the buckle.

Thus in various embodiments, an overall range of motion of pawl 100 (i.e. from a "ready" configuration to an "insertion/removal" configuration) may be e.g. 30, 45, 60, 75 or 90 degrees. In any such embodiment, the maximum alignment between the magnets (both in terms of angular orientation and rectilinear offset), and thus the highest repelling force, may occur after at least 40, 50, 60, 70, or 80% of this range of motion has been traversed.

In particular embodiments, after a condition of maximum alignment and repelling force has been reached, the alignment may decrease at least slightly over the final portion of the range of movement of the pawls (as is evident from comparison of FIG. 3 to FIG. 4). This can provide that when a user is manually pressing the actuating portions of the pawls to urge the pawls into an insertion/removal configuration, a peak repelling force may be reached after which the repelling force may drop somewhat as the pawls approach the very limit of its range of motion. This may still further enhance the sensory feedback that is provided when operating the pawls.

Magnets 150 and 160 may be made of any magnetic material that, in the chosen configuration, provides a desired repelling force. The magnets may be made of the same material, or may be made of different materials. In some embodiments, such a magnet may be made of a ceramic (ferrite) composite, comprising e.g. powdered iron oxide and barium/strontium carbonate. In some embodiments, such a magnet may be made of an alloy such the so-called Alnico (iron-aluminum-nickel-cobalt) materials. In some embodiments, such a magnet may be made of an Al—Mn alloy. In some embodiments, such a magnet may be a rare-earth magnet of any suitable composition. In some specific embodiments, such a magnet may comprise neodymium (e.g., grade N52). Any of these magnets may be coated (e.g. with nickel, copper, and/or zinc) in order to protect the magnetic material.

As noted, such magnets can be obtained e.g. in any size and shape, e.g. as a bar, block, cube, disk, cylinder, ring, arc, or sphere. Blocks (e.g. of approximately 3/16" by 3/16" by 3/16") may be particularly suited for use in a buckle of the size commonly employed in safety harnesses. The magnet size and shape, and material, may be chosen to provide a desired force. Although as disclosed herein, the magnets will be used in a repelling mode, the strength of such magnets may be characterized by their attractive (pull) force, which will be expected to scale with the repelling force. Pull forces of various magnetic materials, of various sizes and shapes, are available from KJ Magnetics, Pipersville, Pa. In various embodiments, magnets as used herein may exhibit a pull force of at least about 1.0, 1.5, 2.0, 2.5, or 3.0 pounds. Such magnets may be magnetized along any desired direction. For example, a cylindrical magnet may be axially magnetized or diametrically magnetized; a bar magnet may be magnetized along any desired axis, and so on, as long as the magnet pair is oriented with the magnetization axis of the magnets positioned to achieve a repelling configuration.

Magnets 150 and 160 may be respectively mounted to pawl 100 and chassis 2 in any desired manner. In some embodiments, an adhesive or potting material (e.g. a photocurable adhesive, a thermally curable adhesive, a moisture-curable adhesive, and so on) may be used. The magnets may be firmly held in place by means of a fixture while the adhesive is cured. In some embodiments, magnet 150 may be seated within an open-ended cavity 111 of pawl 100. Magnet 160 may be seated within an open-ended cavity 18 of chassis 2. Magnet 250 of pawl 200 may be similarly seated within an open-ended cavity 211 of pawl 200, and magnet 260 of may seated within a similar open-ended cavity of chassis 2. If desired, a cavity may comprise a "lip" or "flange" that may enhance the retention of the magnet in the cavity; however, it will be appreciated that since the magnets are configured in a repelling mode, the magnetic force will be expected to push the magnets more firmly into their respective cavities rather than to dislodge them from the cavities. In many convenient embodiments, chassis 2 may be provided by a first plate 3 that is relatively thick and which may provide opposing sidewalls of the chassis and/or may provide room for the various chassis-mounted magnets. In such embodiments, second plate 4 may take the form of a relatively thin lid, as in the exemplary embodiment shown in FIG. 1.

In some embodiments, pawl 100 and/or chassis 2 may be configured to maximize the isolation of the magnets from e.g. dust particles or other debris. Thus for example, in some embodiments first plate 3 of chassis 2 may comprise a protective flange 19 as shown in FIG. 5. Such a flange 19 may extend generally laterally inwardly e.g. from a first sidewall of the chassis of buckle 1 so that when pawl 100 is in its second (or third) configuration, flange 19 is positioned forward of the engaging end 101 of first pawl 100. Such a flange, while not necessarily playing a role in the functioning of the pawls and/or the biasing system, may limit the entry of dust or debris into the space between the magnets. A similar flange may serve a similar protective function for second pawl 200.

In some embodiments, engaging end 101 of pawl 100 may comprise a contact member 112 as shown in FIG. 5. Contact member 112 may rearwardly abut a rearward surface of first protective flange 19, when pawl 100 is in its second (or third) configuration. Contact member 112 may thus overlap protective flange 19 (when buckle 1 is viewed along a generally forward-rearward line of sight); so, contact member 112 and flange 19 may act in combination to limit the entry of dust and debris into the space between the first and second magnets. Contact member 112 may also serve to provide a contact surface 113 that contacts a complementary contact surface 16 of chassis 2, when pawl 100 is rotated to a second (insertion/removal) configuration as in FIG. 3. This can provide a hard stop to the motion of pawl 100 to provide that the exposed surfaces of the magnets (e.g. surfaces corresponding to poles 151 and 161) do not come into contact with each other or with a surface of the chassis or of the pawl. Such arrangements can minimize any wear or abrasion of the exposed surfaces of the magnets. If desired, one or both magnets may be positioned at least partially behind a protective barrier rather than being in an open-ended cavity, as long as the protective barrier does not unacceptably interfere with the repelling force between the magnets.

In some embodiments, various surfaces of pawl 100 and first plate 3 can be configured to limit the entry of dust or debris into the space between the magnets. For example, certain oppositely-facing surfaces of closest approach between pawl 100 and chassis 2 may be configured in this manner. Thus as illustrated in FIG. 5, a generally laterally outward-facing surface 114 of pawl 100, and an opposing, generally laterally inward-facing surface 21 of plate 3 of chassis 2, may both be arcuate and may exhibit congruent curvature over much or all of the area of these surfaces. This can provide that rotation of pawl 100 over its entire range of motion does not result in a gap opening up between these surfaces that might admit dust or debris. Thus in various embodiments, a maximum gap between these surfaces may be less than 1 mm over the entire range of motion of pawl 100. In further embodiments, these surfaces may be locally parallel to each other so that at any given oppositely-facing position on these surfaces, a normal vector of surface 114 of pawl 100 is oriented within plus or minus 30 degrees of a normal vector of surface 21 of plate 3. Any such arrangements as described above for pawl 100, may similarly be used for pawl 200.

Still further, the materials of which the pawls and/or the chassis are made can be chosen to advantage. In some embodiments, the pawls, first plate 3, and/or second plate 4 may all be made of e.g. steel, stainless steel, or the like, as long as such materials do not unacceptably interfere with the ability to manufacture, or use, buckle 1. In some embodiments, the pawls, first plate 3, and/or second plate 4, may be made of a non-ferrous metal (e.g., that is not ferromagnetic). Such metals may include e.g. aluminum, copper, titanium, or zinc, as well as metal alloys such as brass. In some embodiments, one plate of the chassis may be made of ferrous metal while another plate of the chassis is made of non-ferrous metal. In some embodiments, first and second plates 3 and 4 may be made of non-ferrous metal while other components (e.g. slide 8, and/or rivets 6) may be made of e.g. ferrous metal such as steel.

It will be appreciated that the arrangements presented herein may be varied in any number of aspects while still remaining within the scope of the disclosures herein. For example, although discussions herein have concerned pairs of magnets (one magnet being pawl-mounted and one being chassis-mounted), any number of magnets can be used in either location.

The magnetic-repulsion biasing system disclosed herein may be used with any buckle, e.g. of a harness such as a safety harness. It will be appreciated that many variations of buckle design may be used, while still relying on the disclosed magnetic-repulsion biasing system. In some embodiments, the biasing system may be used with a buckle that comprises first and second outer plates and a third, intermediate plate, rather than comprising two plates as disclosed herein. Buckles of this general type are described e.g. in U.S. Pat. No. 6,668,434 to Casebolt, which is incorporated by reference in its entirety herein. In some embodiments, the biasing system may be used with a buckle that includes a locking functionality that serves to press on (e.g. tighten) a webbing that is used with the buckle. Buckles of this general type are described e.g. in U.S. Pat. No. 8,181,319 to Johnson, which is incorporated by reference in its entirety herein.

A buckle as disclosed herein may satisfy certain strength tests; for example, the buckle, when tested with a suitable catch, may exhibit a tensile strength (in which a force is applied to separate the catch from the buckle) of at least 4000 pounds. The buckle may satisfy any applicable performance standard, e.g. ANSI, CSA, EN (CE), and so on.

List of Exemplary Embodiments

Embodiment 1 is a buckle comprising: a main body comprised of at least first and second plates that define a space therebetween; and, first and second counter-rotating pawls that are each positioned in the space between the first and second plates and that are pivotally attached to the main body of the buckle, each pawl comprising an actuating portion that extends outward beyond a perimeter of the main body of the buckle and an engaging portion that comprises an engaging end with at least one tooth that is configured to engage with a shoulder of a forward end of a catch that is slidably insertable into the buckle; wherein the first pawl comprises a first-pawl biasing system that comprises a first magnet that is mounted on the engaging portion of the first pawl in a location forward of an axis of rotation of the first pawl, and a second magnet that is mounted on the main body of the buckle in an orientation that is at least generally in opposition to the first magnet, so that a repelling force between the first and second magnets provides a biasing force that urges the engaging end of the first pawl laterally inward, wherein the second pawl comprises a second-pawl biasing system that comprises a third magnet that is mounted on the engaging portion of the second pawl in a location forward of an axis of rotation of the second pawl, and a fourth magnet that is mounted on the main body of the buckle in an orientation that is at least generally in opposition to the third magnet, so that a repelling force between the third and fourth magnets provides a biasing force that urges the engaging end of the second pawl laterally inward.

Embodiment 2 is the buckle of embodiment 1 wherein at least the first magnet is a rare-earth magnet.

Embodiment 3 is the buckle of embodiment 1 wherein at least the first magnet is a neodymium magnet.

Embodiment 4 is the buckle of any of embodiments 1-3 wherein the first pawl is pivotally attached to the main body of the buckle so as to be rotatably movable along an arcuate path and wherein the first magnet and the second magnet are configured so that at least at some point as the first pawl moves along the arcuate path in a direction that causes the engaging end of the first pawl to move laterally outward away from a lateral centerline of the buckle, the repelling force between the first and second magnets increases.

Embodiment 5 is the buckle of embodiment 4 wherein the first magnet and the second magnet are configured so that at least at some point as the first pawl moves along the arcuate path in the direction that causes the engaging end of the first pawl to move laterally outward away from the lateral centerline of the buckle, a north-south axis of the first magnet becomes more closely aligned with a north-south axis of the second magnet.

Embodiment 6 is the buckle of embodiment 5 wherein the first pawl exhibits a range of motion along the arcuate path, and wherein the first magnet and the second magnet are configured so that a maximum in the alignment between the north-south axis of the first magnet and the north-south axis of the second magnet occurs after at least about 50% of the range of motion has been traversed in a direction that moves the engaging end of the first pawl away from the lateral centerline of the buckle.

Embodiment 7 is the buckle of embodiment 6 wherein the first magnet and the second magnet are configured so that the maximum in the alignment between the north-south axis of the first magnet and the north-south axis of the second magnet occurs after no more than about 90% of the range of motion has been traversed in the direction that moves the engaging end of the first pawl away from the lateral centerline of the buckle.

Embodiment 8 is the buckle of any of embodiments 1-7 wherein any attractive force between the first magnet and the third magnet exhibits a magnitude that is less than 5% of a repelling force between the first magnet and the second magnet, over an entirety of a range of counter-rotatable motion of the first and second pawls.

Embodiment 9 is the buckle of any of embodiments 1-8 wherein at least the first magnet exhibits a pull force of at least about 2 pounds.

Embodiment 10 is the buckle of any of embodiments 1-9 wherein the first magnet is attached to the first pawl by an adhesive, and wherein the second magnet is attached to the first plate of the main body of the buckle by an adhesive.

Embodiment 11 is the buckle of any of embodiments 1-10 wherein the first and second pawls are counter-rotatably movable between at least a first configuration in which engaging ends of the first and second pawls are at a distance of closest approach to each other, and a second configuration in which the engaging ends of the pawls are more widely separated from each other than when in the first configuration, and in which second configuration major laterally-inward-facing contact surfaces of the pawls are at least generally parallel to each other.

Embodiment 12 is the buckle of embodiment 11 wherein the main body comprises a first protective flange that extends generally laterally inwardly from a first sidewall of the main body so that the first protective flange is positioned forward of the engaging end of the first pawl; and, a second protective flange that extends generally laterally inwardly from a second, opposing sidewall of the main body so that the second protective flange is positioned forward of the engaging end of the second pawl, when the first and second pawls are in the second configuration.

Embodiment 13 is the buckle of embodiment 12 wherein the first pawl comprises a first contact member that rearwardly abuts a rearward surface of the first protective flange, and the second pawl comprises a second contact member that rearwardly abuts a rearward surface of the second protective flange, when the first and second pawls are in the second configuration.

Embodiment 14 is an assembly comprising the buckle of any of embodiments 1-13 with a catch slidably inserted in the buckle and secured in place by the first and second pawls.

Embodiment 15 is the assembly of embodiment 14 further comprising a first webbing attached to a slider of the buckle, and a second webbing that is attached to a rear bar of the catch.

Embodiment 16 is the assembly of any of embodiments 14-15 wherein the catch is comprised of a non-ferrous metal, and wherein the first plate and the second plate of the main body of the buckle are each comprised of non-ferrous metal.

Embodiment 17 is a safety harness for a human user, comprising the buckle of any of embodiments 1-13 or the assembly of any of embodiments 14-16.

Embodiment 18 is the safety harness of embodiment 17, further comprising at least one catch that is configured to be slidably inserted into, and secured in place within, the buckle.

Embodiment 19 is the safety harness of embodiment 18, wherein a first webbing of the safety harness is attached to the buckle and a second webbing of the safety harness is attached to the catch.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document that is incorporated by reference herein but to which no priority is claimed, this specification as written will control.

What is claimed is:

1. A buckle; comprising:

a main body comprised of at least first and second plates that define a space therebetween; and, first and second counter-rotating pawls that are each positioned in the space between the first and second plates and that are pivotally attached to the main body of the buckle, each pawl comprising an actuating portion that extends outward beyond a perimeter of the main body of the buckle and an engaging portion that comprises an engaging end with at least one tooth that is configured to engage with a shoulder of a forward end of a catch that is slidably insertable into the buckle;

wherein the first pawl comprises a first-pawl biasing system that comprises a first magnet that is mounted on the engaging portion of the first pawl in a location forward of an axis of rotation of the first pawl, and a second magnet that is mounted on the main body of the buckle in an orientation that is in opposition to the first magnet, so that a repelling force between the first and second magnets provides a biasing force that urges the engaging end of the first pawl laterally inward, wherein the second pawl comprises a second-pawl biasing system that comprises a third magnet that is mounted on the engaging portion of the second pawl in a location forward of an axis of rotation of the second pawl, and a fourth magnet that is mounted on the main body of the buckle in an orientation that is in opposition to the third magnet, so that a repelling force between the third and fourth magnets provides a biasing force that urges the engaging end of the second pawl laterally inward.

2. The buckle of claim 1 wherein at least the first magnet is a rare-earth magnet.

3. The buckle of claim 1 wherein at least the first magnet is a neodymium magnet.

4. The buckle of claim 1 wherein the first pawl is pivotally attached to the main body of the buckle so as to be rotatably movable along an arcuate path and wherein the first magnet and the second magnet are configured so that at least at some point as the first pawl moves along the arcuate path in a direction that causes the engaging end of the first pawl to move laterally outward away from a lateral centerline of the buckle, the repelling force between the first and second magnets increases.

5. The buckle of claim 4 wherein the first magnet and the second magnet are configured so that at least at some point as the first pawl moves along the arcuate path in the direction that causes the engaging end of the first pawl to move laterally outward away from the lateral centerline of the buckle, a north-south axis of the first magnet becomes more closely aligned with a north-south axis of the second magnet.

6. The buckle of claim 5 wherein the first pawl exhibits a range of motion along the arcuate path, and wherein the first magnet and the second magnet are configured so that a maximum in the alignment between the north-south axis of the first magnet and the north-south axis of the second magnet occurs after at least about 50% of the range of motion has been traversed in a direction that moves the engaging end of the first pawl away from the lateral centerline of the buckle.

7. The buckle of claim 6 wherein the first magnet and the second magnet are configured so that the maximum in the alignment between the north-south axis of the first magnet and the north-south axis of the second magnet occurs after no more than about 90% of the range of motion has been traversed in the direction that moves the engaging end of the first pawl away from the lateral centerline of the buckle.

8. The buckle of claim 1 wherein any attractive force between the first magnet and the third magnet exhibits a magnitude that is less than 5% of a repelling force between the first magnet and the second magnet, over an entirety of a range of counter-rotatable motion of the first and second pawls.

9. The buckle of claim 1 wherein at least the first magnet exhibits a pull force of at least about 2 pounds.

10. The buckle of claim 1 wherein the first magnet is attached to the first pawl by an adhesive, and wherein the second magnet is attached to the first plate of the main body of the buckle by an adhesive.

11. The buckle of claim 1 wherein the first and second pawls are counter-rotatably movable between at least a first configuration in which engaging ends of the first and second pawls are at a distance of closest approach to each other, and a second configuration in which the engaging ends of the pawls are more widely separated from each other than when in the first configuration, and in which second configuration major laterally-inward-facing contact surfaces of the pawls are parallel to each other.

12. The buckle of claim 11 wherein the main body comprises a first protective flange that extends laterally inwardly from a first sidewall of the main body so that the first protective flange is positioned forward of the engaging end of the first pawl; and, a second protective flange that extends laterally inwardly from a second, opposing sidewall of the main body so that the second protective flange is positioned forward of the engaging end of the second pawl, when the first and second pawls are in the second configuration.

13. The buckle of claim 12 wherein the first pawl comprises a first contact member that rearwardly abuts a rearward surface of the first protective flange, and the second pawl comprises a second contact member that rearwardly abuts a rearward surface of the second protective flange, when the first and second pawls are in the second configuration.

14. An assembly comprising the buckle of claim 1 with a catch slidably inserted in the buckle and secured in place by the first and second pawls.

15. The assembly of claim 14 further comprising a first webbing attached to a slider of the buckle, and a second webbing that is attached to a rear bar of the catch.

16. The assembly of claim 14 wherein the catch is comprised of a non-ferrous metal, and wherein the first plate and the second plate of the main body of the buckle are each comprised of non-ferrous metal.

17. A safety harness for a human user, comprising the buckle of claim 1.

18. The safety harness of claim 17, further comprising at least one catch that is configured to be slidably inserted into, and secured in place within, the buckle.

19. The safety harness of claim 18, wherein a first webbing of the safety harness is attached to the buckle and a second webbing of the safety harness is attached to the catch.

* * * * *